United States Patent [19]

Nilssen

[11] Patent Number: 4,645,942

[45] Date of Patent: Feb. 24, 1987

[54] CLOCK WITH PROGRAMMABLE ACTUATOR MEANS

[76] Inventor: Ole K. Nilssen, Caesar Dr., Barrington, Ill. 60010

[21] Appl. No.: 719,723

[22] Filed: Apr. 4, 1985

[51] Int. Cl.[4] ..... H01H 7/16

[52] U.S. Cl. ..... 307/140; 307/126; 315/360

[58] Field of Search ..... 307/119, 126, 134, 140, 307/141, 149, 150; 368/246, 256, 258, 259, 10; 315/360

[56] References Cited

U.S. PATENT DOCUMENTS

| | | | |
|---|---|---|---|
| 3,878,345 | 4/1975 | Hauser | 307/141 X |
| 3,949,241 | 4/1976 | Maute | 307/141 |
| 3,985,982 | 10/1976 | Schneidinger | 200/28 A X |
| 4,002,925 | 1/1977 | Monahan | 315/360 X |
| 4,570,216 | 2/1986 | Chan | 307/140 X |

*Primary Examiner*—William M. Shoop, Jr.

*Assistant Examiner*—Bentsu Ro

[57] ABSTRACT

A programmable quartz clock has an actuator means operable to engage with and to actuate a control lever of a mechanically actuatable entity, such as a slide switch or a wall switch, thereby to effect programmed actuation of this entity.

The clock comprises a small battery, a miniature electric motor with a gear/linkage mechanism operable to engage with and to move said lever, integrated circuit means, a quartz element, numeric display means, and programming means receptive of programming instructions by way of programming input keys.

Once programmed by way of the input keys, the clock is operative to cause the electric motor to operate in such manner as to move the control lever in accordance with the keyed-in program. In its anticipated most common operating mode, which includes an average total of six actuations per day, the small battery will last for years before needing replacement.

29 Claims, 4 Drawing Figures

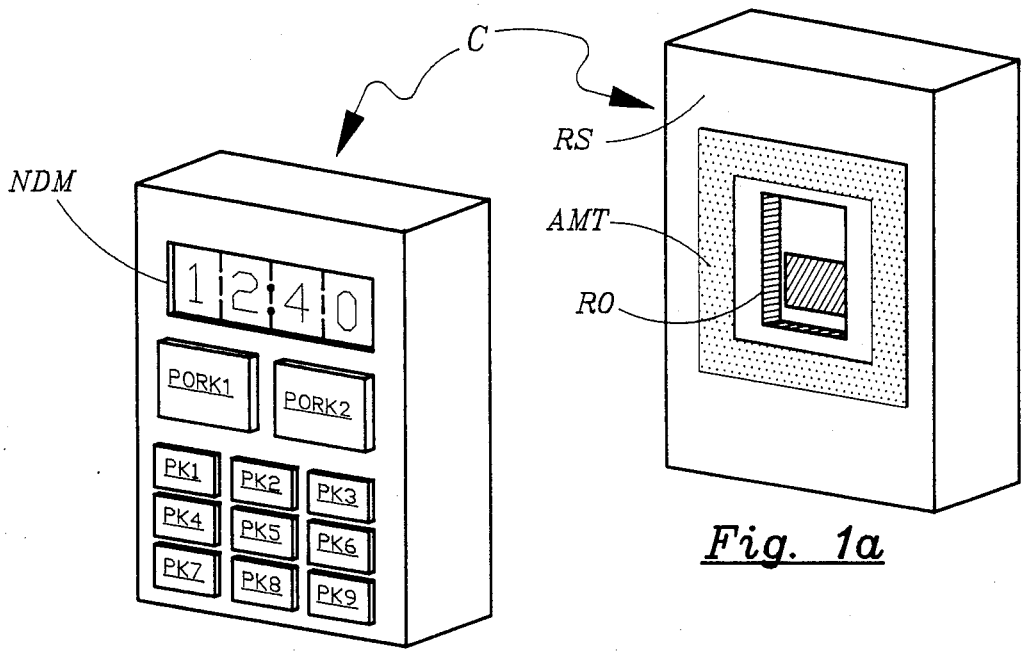
Fig. 1a
Fig. 1b
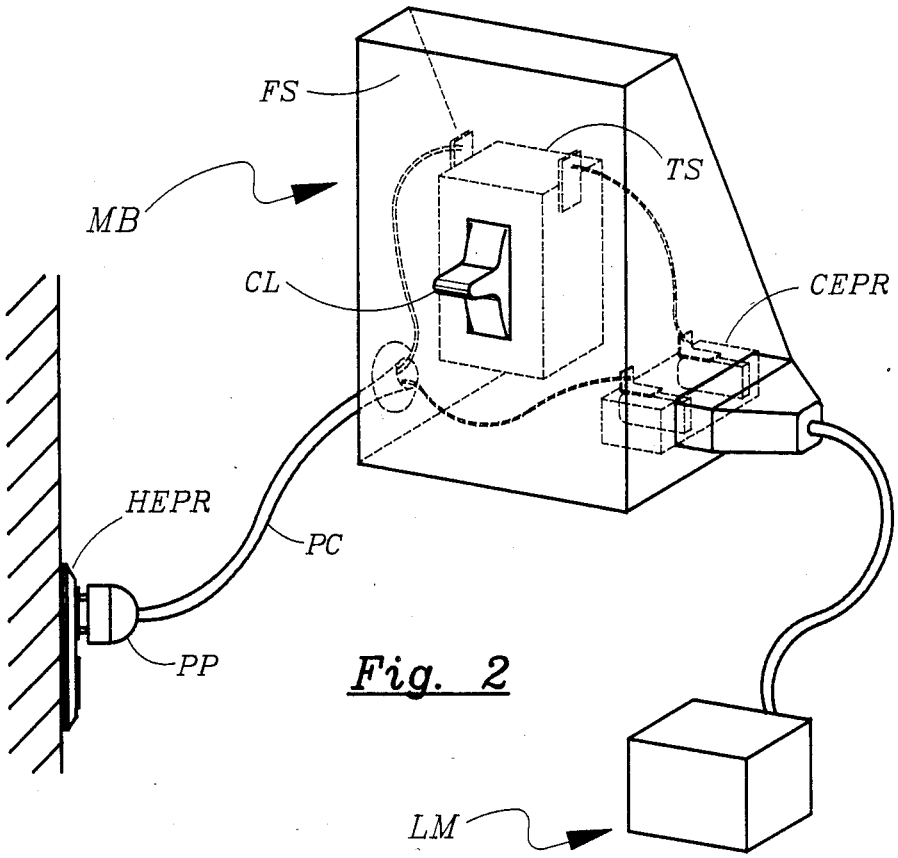
Fig. 2

CLOCK WITH PROGRAMMABLE ACTUATOR MEANS

BACKGROUND OF THE INVENTION

Field of Invention

The present invention relates to a programmable quartz clock comprising actuator means operable to programmably actuate a mechanically actuatable entity.

SUMMARY OF THE INVENTION

Brief Description

In its preferred embodiment, subject invention constitutes a programmable quartz clock with an actuator means operable to engage with and to programmably actuate a control lever of a mechanically actuatable switch means, such as a toggle switch or a slide switch. Also, the clock has means to facilitate easy mounting thereonto of such a switch means.

The clock comprises a small center-tapped battery, a miniature electric motor with a gear/linkage mechanism operable to engage with and to move said control lever to any desired specific position between its extreme fully-ON and fully-OFF positions, integrated circuit means, a quartz element, numeric display means, and programming means receptive of programming instruction by way of programming input keys.

Once programmed by way of the programming input keys, the clock is operative to control the electric motor in such manner as to move the control lever between different specific positions in accordance with the keyed-in program. In its anticipated most common operating mode, which includes a total of six actuations per day, the small battery will last for years before needing replacement.

BRIEF DESCRIPTION OF THE DRAWINGS

FIG. 1 shows the clock in two perspective views; FIG. 1*a* shows a view predominantly from the rear; and FIG. 1*b* shows a view predominantly from the front.

FIG. 2 represents a mainly frontal perspective view of a toggle switch combined with a mounting base, with the switch control lever protruding through an aperture in this mounting base and with this mounting base having a power cord with a power plug and a receptacle means adapted to accept a power plug.

DESCRIPTION OF THE PREFERRED EMBODIMENT

Details of Construction

FIG. 1*a* shows a view predominantly from the rear of the clock C. Positioned substantially in the middle of the rear surface RS is a rear opening RO operable to receive a lever from an entity to be mechanically controlled.

Adhesive mounting tape AMT is positioned on the back surface of clock C in a substantially rectangular fashion centered around rear opening RO.

FIG. 1*b* shows a view predominantly from the front of the clock. Positioned near the top of the front surface is a numeric display means NDM, below which—positioned approximately in the center of the front surface—is a pair of relatively large-size program over-ride keys PORK1 and PORK2. Near the bottom of the front surface is a set of nine calculator-type programming keys PK1 to PK9.

FIG. 2 shows a mainly frontal perspective view of a mounting base MB having a front surface FS. Approximately in the middle of this front surface is an aperture through which protrudes the control lever CL of a toggle switch TS, as shown in phantom. A power cord PC with a power plug PP connects the mounting base with an ordinary wall-mounted household electric power receptacle HEPR. Inside the mounting base, as shown in phantom, the first conductor of the power cord is directly connected with the first terminal of a controlled electric power receptacle CEPR, which receptacle is an integral part of mounting base MB. The second conductor of the power cord is connected to the first terminal of a two-pole single-throw toggle switch TS. The second terminal of switch TS is connected with the second terminal of receptacle CEPR. A load means LM is plugged into receptacle CEPR.

Figure 3:
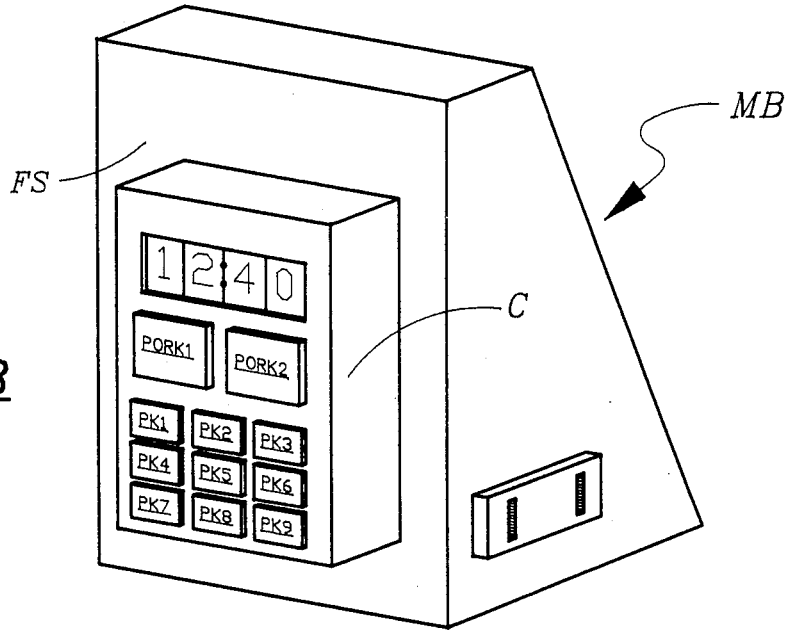
FIG. 3 shows the clock as mounted over the control lever on the front of the mounting base.

FIG. 3 shows clock C mounted on mounting base MB, being fastened right onto front surface FS by way of adhesive mounting tape AMT.

Figure 4:
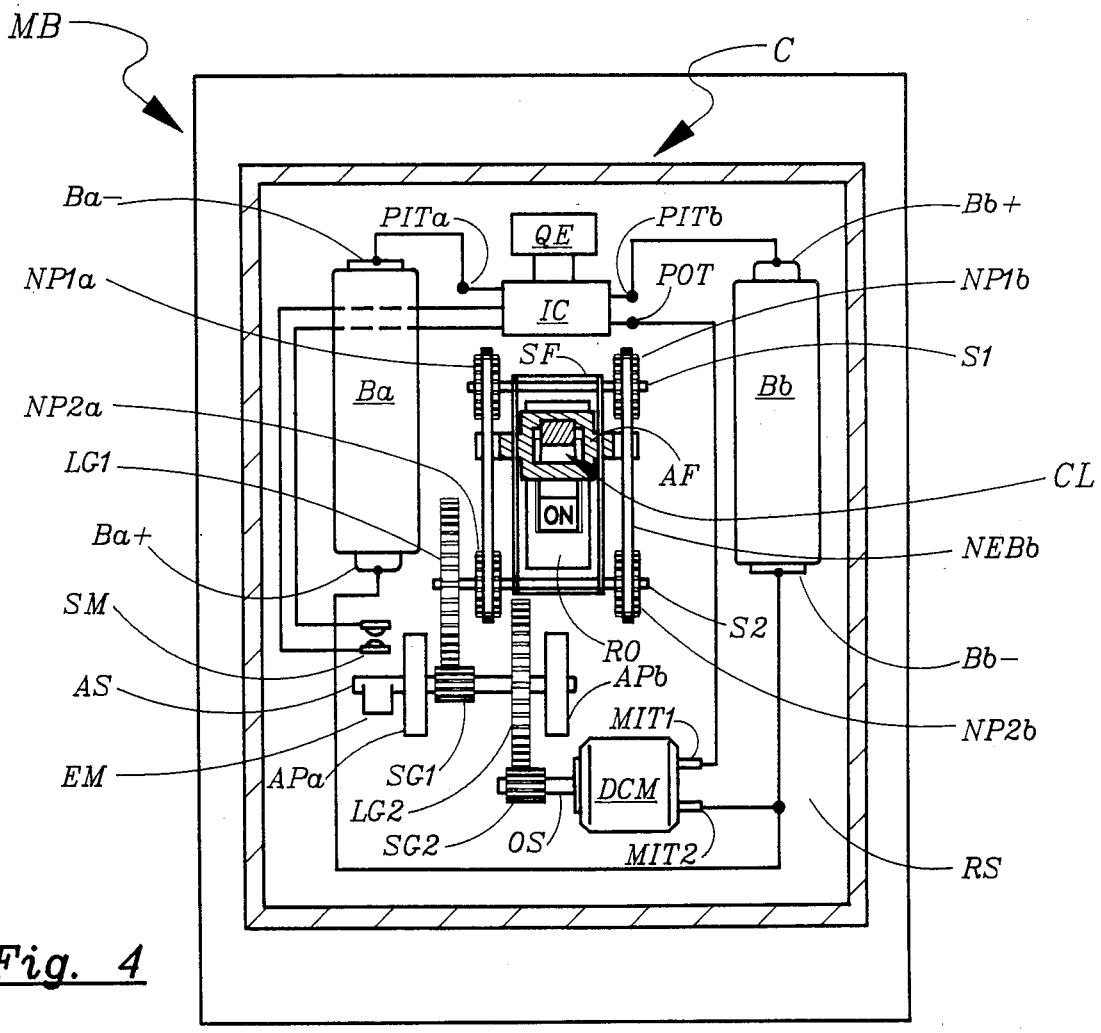
FIG. 4 represents a front view of the key components comprised within the clock.

FIG. 4 shows a schematic frontal view of the inside of clock C as mounted onto mounting base MB. Control lever CL, which protrudes through rear opening RO, is shown in its fully-ON position.

Surrounding the rear opening and fastened onto rear surface RS of the clock is a rectangular support frame SF. A first shaft S1 with notched pulleys NP1a and NP1b is supported by this frame near its upper extremity; a second shaft S2 with notched pulleys NP2a and NP2b is supported by this frame near its lower extremity. Both of these shafts are free to rotate, but are not free to move in any other respects.

A small notched endless belt NEBa connects pulley NP1a with pulley NP2a; and a small notched endless belt NEBb similarly connects pulley NP1b with pulley NP2b. Symmetrically fastened onto both of these endless belts is an actuator frame AF; which frame is so made and positioned as to embrace control lever CL. As the actuator frame AF moves, it slides on support frame SF.

Shaft S2 has an extension onto which is mounted a first large gear LG1. An auxiliary shaft AS is rotatably mounted between two auxiliary posts APa and APb; which posts are fastened to the rear surface RS. Mounted onto this auxiliary shaft is a second large gear LG2 and a first small gear SG1. This first small gear SG1 is engaged with the first large gear LG1.

Also mounted onto an extension of this auxiliary shaft AS is an eccentric means EM that operates a preferably bistable switch means SM once for each complete revolution of shaft AS. This switch means has two terminals, both of which are connected with an integrated circuit IC.

A small DC motor DCM is mounted on rear surface RS. On the output shaft OS of this DC motor is mounted a second small gear SG2. This second small gear SG2 is engaged with the second large gear LG2. The DC motor has two electrical power input terminals MIT1 and MIT2.

A first battery Ba is positioned on the left hand side of rear surface RS; and a second battery Bb is positioned on the right hand side of rear surface RS. Battery Ba has a Ba− terminal and a Ba+ terminal, with the Ba− terminal being of negative polarity with respect to the Ba+ terminal. Similarly, battery Bb has a Bb− terminal and a Bb+ terminal, with the Bb− terminal being of negative polarity with respect to the Bb+ terminal. The Ba+ terminal is electrically connected with the DC motor's MIT2 terminal as well as with the Bb− terminal.

Integrated circuit IC and a quartz element QE are located near the upper part of the actuator means—in a position that would be substantially directly underneath the numeric display means NDM of FIG 1*b*. This IC has a relatively large number of electrical terminals, most of which are connected with the quartz element QE, the numeric display means NDM, the programming keys PK1 to PK9, and the program-over-ride keys PORK1 and PORK2. However, for sake of clarity, and also since they form no part of the present invention, the detailed electrical connections between the IC and QE, NDM, PK1 to PK9, PORK1 and PORK2 are not shown.

Of course, the detailed construction of a programmable clock means based on a quartz-controlled IC and a numeric display means is well known from prior art.

The remaining IC electrical terminals and connections are shown: electrical power input terminal PITa is electrically connected with battery terminal Ba−; electrical power input terminal PITb is electrically connected with battery terminal Bb+; electrical power output terminal POT is electrically connected with motor input terminal MIT1; and the two terminals of switch means SM is connected with two control input terminals on the IC.

As indicated in FIG. 3, the size and shape of the overall clock is such as to provide for attractive styling: the unit's depth or thickness dimension has been made as shallow as permissible by the size of the switch control lever, yet without having this lever exposed.

To permit the size and shape of the clock to be as compact as desired, which degree of compactness is in effect specified by FIG. 3, it is important that the individual components comprised within the clock be fittingly small. In practical reality, this concern is only important in respect to the battery and the motor.

Thus, the electrical power required to be supplied from the built-in battery must be modest enough to permit this battery to be small enough to reasonably fit within the desired specified dimensions of the actuator means. Similarly, the mechanical power required to be supplied by the built-in motor must be modest enough to permit this motor to be small enough to reasonably fit within the specified dimensions.

Since a certain amount of energy is required to effect actuation of the switch control lever, the power required is inversely proportional to the time allowed to effect this actuation. Thus, by way of a speed-reducing gear mechanism, it becomes possible to actuate the control lever at an arbitrarily small power level.

By allowing complete actuation of the switch control lever, from its extreme fully-On position to its extreme fully-OFF position, to take about one second from start to finish, the motor power output requirement gets to be acceptably modest; and actuation can then readily be accomplished by way of a substantially conventional miniature DC motor of dimensions no larger than 10 mm×20 mm×20 mm. Correspondingly, the electrical power required by the motor now becomes adequately modest to permit the use of two ordinary AAA-cells for the built-in battery.

During the process of actuation, actuator frame AF is apt to slide up and down on the rim of support frame SF. Also, as the control lever is being pushed up or down by the actuator frame, there is a degree of sliding between the control lever and one or another of the inner edges of the actuator frame. To minimize power waste, low-friction surfaces have been provided.

Details of Operation

With reference to FIG. 4, when the DC motor is provided with a DC voltage across its electrical input terminals, the motor's output shaft will rotate in a direction corresponding to the polarity of this DC voltage. The rotating motor shaft will, by way of the indicated gear and pulley arrangement, cause the actuator frame to move up or down, thereby causing switch control lever CL to move correspondingly. With the MIT1 terminal being positive with respect to the MIT2 terminal, the motor shaft rotates in such direction as to cause the actuator frame to move the control lever in the down-direction, thereby eventually causing the load controlled by the switch to be switched OFF.

Correspondingly, with the MIT1 terminal being negative with respect to the MIT2 terminal, the motor shaft rotates in such direction as to cause the actuator frame to move the switch control lever in the up-direction, thereby eventually causing the load controlled by the switch to be switched ON.

The overall function of the clock, aside from providing current information in respect to the correct time-of-day, involves the programmed actuation by the IC of the DC motor in the one or the other direction, thereby moving the switch control lever either up or down to correspondingly switch the load ON or OFF. The quartz element in combination with the IC acts as an accurate time-base for providing programmable diurnally or other cyclical type of repetitive actuations of the switch control lever.

With reference to FIG. 3, once mounted in its place on the mounting base, the operation and programming of the clock and its associated actuator means is accomplished as follows.

(a) By momentarily depressing PK1, the control lever will be moved a predetermined small distance toward its ON position. By repeating this operation, the control lever can be step-wise moved all the way to its extreme ON position. Similarly, by way of PK2, the control lever can be stepwise moved toward its extreme OFF position. Thus, by way of the PK1/PK2 keys, the control lever can be positioned to any one of numerous different positions between the extreme ON position and the extreme OFF position.

(b) Current time-of-day is programmed into the clock by first momentarily depressing PK3, and then by depressing the hour-roll key PK4 and the minute-roll key PK5 until the correct hour and minute are displayed on the numeric display means NDM. After correct current time-of-day is reached, PK3 is depressed once more, thereby securing the time-of-day setting.

(c) A load actuation program is established by the following sequence of actions: (i) momentarily depress PK6; (ii) by way of PK1 or PK2, select a position of the switch control lever that corresponds to a first desired state of the switch (say, OFF); (iii) by way of PK3 and PK4, select a first desired time-of-day at which this first desired state is to begin; and (iv) momentarily depress PK6 again, thereby to secure this particular set of instructions. Then, by following a corresponding procedure with PK7, a second desired switch state can be chosen (say, ON) to begin at some second desired time-of-day. The PK8 and PK9 keys may then similarly be programmed; whereafter the clock will proceed to execute the various desired actuations at the various desired points in time, while the numeric display means NDM indicates current time-of-day.

(d) Adjustment of the program-over-ride-key PORK1 is accomplished by: (i) momentarily depressing PORK1; (ii) by way of the PK1/PK2 keys, move the switch control lever to a position where the load is completely switched ON—but not necessarily all the way to the extreme ON position; and (iii) momentarily depressing PORK1 once more; whereafter, each time PORK1 is momentarily depressed once, the load will be switched ON.

(e) Adjustment of program-over-ride-key PORK2 is accomplished in a manner that is entirely analogous to that used for adjusting program-over-ride-key PORK1, except for that of using the PK1/PK2 keys to bring the switch control lever into a position that corresponds to the load being fully switched OFF.

(f) With additional reference to FIG. 4, as auxiliary shaft AS revolves, switch means SM opens and closes once for each revolution. This effect is used for accomplishing the step-wise movement that can be actuated by the PK1/PK2 keys. Specifically, when PK1 is momentarily depressed, the IC is initiated to provide voltage to the motor of such polarity as to cause the control lever to start moving toward the fully-ON position. However, this movement is stopped as soon as eccentric means EM causes switch means SM to close, thereby causing the IC to stop providing voltage to the motor. An additional momentary push on the PK1 key re-initiates the IC to again provide voltage to the motor, but only until switch means SM again closes, etc.

With the particular gear ratios chosen, auxiliary shaft AS performs 24 complete revolutions while the switch control lever moves all the way between its extreme ON position to its extreme OFF position. Thus, with one closing of switch means SM per revolution, it takes 24 momentary pushes of the PK1 key to move the control lever all the way from its extreme OFF position to its extreme ON position.

Comments

It is not necessary to use a center-tapped battery for the proper operation of the actuator/timer unit. A single battery could be used in conjunction with providing for double-pole double-throw switching, either by the IC or by mechanical means actuated in accordance with the position of the actuator frame. Or, as yet another alternative, it would be possible to use a regular two-terminal battery in combination with a three-terminal motor.

In its preferred embodiment, subject clock and actuator means has a built-in diurnal cycle; which is to say that whatever switch control pattern that is programmed into this clock and actuator means will automatically repeat every 24 hours. However, it is routinely possible to provide for other programming periods. For instance, in many cases a seven-day cycle would be advantageous.

It is not necessary to have the clock/actuator means mounted on the special mounting base of FIG. 2. Rather, it would be possible to mount it in a variety of places where a control lever is to be controlled. For instance, it would be possible to mount the clock/actuator directly on the face plate of an ordinary wall switch, thereby to permit programmed control of the load controlled by this wall switch.

The adhesive mounting tape is so chosen that the clock and actuator means can be securely mounted simply by being pressed onto a flat surface. Also, it can normally be removed without leaving any mark on that surface; although it may then be necessary to apply a new piece of mounting tape before re-mounting.

Instead of the notched pulleys and the notched belts described in connection with FIG. 4, it is possible to use gears and gear-belts (such as so-called timing belts).

The IC described in connection with FIG. 4 will have to be designed to provide the particular programming functions specified. However, an IC of such design represents a routine undertaking and forms no part of the present invention.

Instead of having a toggle switch in the mounting base of FIG. 2, it would be possible to have a so-called Light Demand Switch, as marketed by Power Controls Corporation of San Antonio, Tex. 78296. This Light Demand Switch has a control lever that is substantially identical to that of a regular wall switch; and the power provided to a load controlled by such a Light Demand Switch is substantially proportional to the position of the control shaft relative to its fully-OFF and its fully-ON positions. Thus, in this case it would be possible to actuate the control lever in a programmed proportional way, thereby to provide a number of different desired levels of power to the load during a number of different desired periods in time.

It is believed that the present invention and its several attendant advantages and features will be understood from the preceeding description. However, without departing from the spirit of the invention, changes may be made in its form and in the construction and interrelationships of its component parts, the form herein presented merely representing the presently preferred embodiment.

I claim:

1. A clock having actuator means operable to move back and forth a switch lever such as that of an ordinary electric wall switch, said switch lever being attached in controlling relationship to a power control means operable to control the flow of power between a voltage source and a load, comprising:

structure means having an aperture operable to receive said switch lever;

energy source means physically supported by said structure means and operable to supply electric power independently of said voltage source;

display means physically supported by said structure means and operative when actuated to provide visually discernible indication of time;

mechanical actuator means physically supported by said structure means and operable to engage with and, when so engaged and when actuated, to cause controllable back and forth movement of said switch lever; and time-keeping and programming means connected in circuit between said energy source means, said display means and said mechanical actuator means; said time-keeping and programming means: (i) having means for keeping accurate time and for actuating said display means, (ii) being receptive of programming instructions to establish a program, and (iii) being operable to actuate said mechanical actuator means in accordance with said program, thereby to cause corresponding movement of said lever.

2. The clock of claim 1 wherein said lever has a first position at which substantially no power is provided to said load and a second position at which a maximum amount of power is provided to said load, and wherein said mechanical actuator means is operable to move said lever into any one of numerous positions between said first position and said second position.

3. The actuator means of claim 1 wherein said structure means is operable to be detachably attached to said power control means.

4. The actuator means of claim 1 wherein said energy source means comprises an electric battery.

5. The actuator means of claim 1 wherein said time-keeping and programming means is operable by way of said display means to provide visually discernible information indicative of said programming instructions.

6. The clock of claim 1 wherein said mechanical actuator means comprises an electric motor.

7. The clock of claim 1 wherein said time-keeping and programming means comprises mechanically actuatable input means operative to permit manual receipt of said programming instructions, thereby to permit modifications of said program.

8. The clock of claim 1 in which said program provides for said lever to be moved back and forth in a cyclically repeated manner.

9. The clock of claim 8 wherein said program provides for said lever to be moved in a diurnally repeated manner.

10. A clock means comprising:

structure means having an aperture operable to receive a switch control lever, such as the lever of an ordinary toggle switch;

energy source means physically supported by said structure means and operable to supply electric power independent of any connection with an electric power line;

mechanical actuator means physically supported by said structure means and operable to engage with and, when so engaged and when actuated, to cause bi-directional movement of said switch control lever; and time-keeping and programming means connected in circuit between said energy source means and said mechanical actuator means; said time-keeping and programming means: (i) having means for keeping a record of time-of-day, (ii) being receptive of programming instructions to establish a program based in part on said record, and (iii) being operable to actuate said mechanical actuator means in accordance with said program, thereby to cause corresponding movement of said switch control lever;

whereby said clock means is operable to cause bi-directional movement of said control lever in accordance with said program and without having to be powered from an electric utility power line or from any source other than said energy source means.

11. The clock means of claim 10 having display means connected in circuit with said energy source means and said time-keeping and programming means, and operable to provide visually discernible indication of time-of-day.

12. The clock means of claim 10 wherein said time-keeping and programming means has manual input means receptive of said programming instructions.

13. The clock means of claim 10 wherein said mechanical actuator means comprises an electric motor.

14. The clock means of claim 10 wherein said energy source means comprises an electric battery.

15. The clock means of claim 10 wherein said switch control lever protrudes from a mounting means, and wherein said structure means is operative to permit detachable attachment to said mounting means.

16. The clock means of claim 10 wherein said mechanical actuator means, as actuated by said time-keeping and programming means, is operable to move said switch control lever into any one of a plurality of different positions.

17. A clock-actuated power control arrangement comprising:

power control means having a movable control lever protruding from a surface and operative, by way of its physical position in respect to this surface, to affect the flow of power between a voltage source and a load; and programmable actuator means mountable onto said surface, said programmable actuator means having: (i) clock-means for keeping track of trime-of-day, (ii) programming input means respective of programming instructions to establish a program based in part on said time-of-day, (iii) actuation means physically connectable with and operable to move said control lever in accordance with said program, and (iv) energy source independent of said voltage source and operable to provide operating power to said clock-means and said actuation means.

18. The arrangement of claim 17 wherein said programmable actuator means comprises display means operative to provide visually discernible indication of current time-of-day.

19. The arrangement of claim 17 wherein said programmable actuator means comprises display means operative to provide visually discernible indication of said programming instructions.

20. The arrangement of claim 17 wherein said programmable actuator means comprises its own built-in energy source, thereby not requiring connection with a public utility power line or any other external source of power.

21. The arrangement of claim 17 wherein said actuation means comprises DC motor means operative to effectuate movement of said control lever.

22. The arrangement of claim 17 wherein said control lever is movable into a plurality of different positions and wherein said actuation means is operable to move this control lever into any one of this plurality of different positions.

23. The arrangement of claim 17 wherein said control lever is movable into a plurality of different positions and wherein said actuation means is operable to move this control lever between any two of this plurality of different positions.

24. The arrangement of claim 17 wherein all parts of said programmable actuator means is electrically isolated from said voltage source.

25. The arrangement of claim 17 wherein said programmable actuator means is mountable onto said surface by way of adhesive means.

26. The arrangement of claim 17 wherein said programmable actuator means is removably mountable onto said suface without requiring the use of any tool.

27. The arrangement of claim 17 wherein said programming input means is receptive of manual programming instructions.

28. A clock and actuator means comprising:

a housing means having an aperture operable to receive a lever required to be controllably moved in a bi-directional manner;

electric battery means substantially contained within said housing means;

mechanical actuator means substantially contained within said housing means and operable to engage with and, when so engaged and when actuated, to cause bi-directional movement of said lever, the actuator means comprising a DC motor means; and programming means connected in circuit with said battery means and said mechanical actuator means; said programming means having: (i) timing means for keeping record of time-of-day, this timing means being operable independent of the DC motor means, (ii) programming input means receptive of programming instructions to establish a program based in part on said record of time-of-day, and (iii) actuation output means operable to actuate said mechanical actuator means in accordance with said program, thereby to cause corresponding controlled bi-directional movement of said lever.

29. A clock and actuator means comprising:

a housing means having: (i) an aperture operable to receive a lever protruding from a surface and required to be controllably moved in a bi-directional manner, (ii) means operable to permit detachable attachment to said surface;

electric battery means substantially contained within said housing means;

electrically operable mechanical actuator means substantially contained within said housing means and operable to engage with and, when so engaged and when actuated, and provided a lever has been received by and is located in said aperture, to cause bi-directional movement of this lever; and programming means connected in circuit between said battery means and said actuator means, and having: (i) a time-keeping means operative to keep a record of time-of-day, (ii) programming input means receptive of digital programming instructions to establish a program based in part on said record of time-of-day, and (iii) electric actuation output means operable to actuate said actuator in accordance with said program, thereby to cause corresponding controlled movement of said lever.

* * * * *